United States Patent [19]

Evans

[11] Patent Number: 4,588,094

[45] Date of Patent: May 13, 1986

[54] WALL-MOUNTED FILE TRAY

[75] Inventor: Dale M. Evans, Windsor, Wis.

[73] Assignee: Don Evans, Inc., DeForest, Wis.

[21] Appl. No.: 656,027

[22] Filed: Sep. 28, 1984

[51] Int. Cl.[4] ..... A47F 7/00

[52] U.S. Cl. ..... 211/55; 211/126

[58] Field of Search ..... 211/55, 56, 50, 45, 211/128, 126, 194, 88

[56] References Cited

U.S. PATENT DOCUMENTS

| | | | |
|---|---|---|---|
| 1,552,510 | 9/1927 | Scofield | 211/88 |
| 3,563,394 | 2/1971 | Joyce | 211/126 |
| 3,581,906 | 6/1971 | Joyce | 211/126 |
| 3,606,949 | 2/1969 | Joyce | 211/126 |
| 3,642,144 | 2/1972 | Brooks | 211/45 |
| 3,842,982 | 10/1974 | Joyce | 211/126 |
| 4,062,452 | 12/1977 | Bartholomew | 211/55 |
| 4,079,841 | 3/1978 | Castel | 211/50 X |

FOREIGN PATENT DOCUMENTS

| | | | |
|---|---|---|---|
| 117286 | 2/1901 | Fed. Rep. of Germany | 211/50 |

*Primary Examiner*—Ramon S. Britts
*Assistant Examiner*—Sarah A. Lechok Eley
*Attorney, Agent, or Firm*—Isaksen, Lathrop, Esch, Hart & Clark

[57] ABSTRACT

A file tray adapted to be mounted on a generally vertical wall with headed fasteners driven into the wall. The file tray is adapted to serve both as a primary and secondary file tray in a vertical array including a primary file tray and at least one secondary file tray. A vertically oriented mounting surface is adapted to rest against the wall on which the file tray is mounted. A back wall extends forwardly and upwardly from the mounting surface for a selected distance. A back wall flange extends from the top of the back wall rearwardly to the mounting surface. The file tray has compartment having at least a floor and including the back wall. The mounting surface includes bottom and top mounting tabs having notches and holes adapted to engage the shank of a headed fastener so that the head thereof retains the file tray on the wall. The back wall and back wall flange are so notched and channeled as to receive the top or bottom mounting tabs from secondary file trays mounted below or above a primary file tray in such a fashion as to allow secondary file trays to be added above or below a primary file tray without the need to remove the primary file tray from the wall.

14 Claims, 8 Drawing Figures

10
18
26
40
30
16
18
36
40
28
20
30
12
19
21
14
20
19
16
21
12
10
14

Fig 2
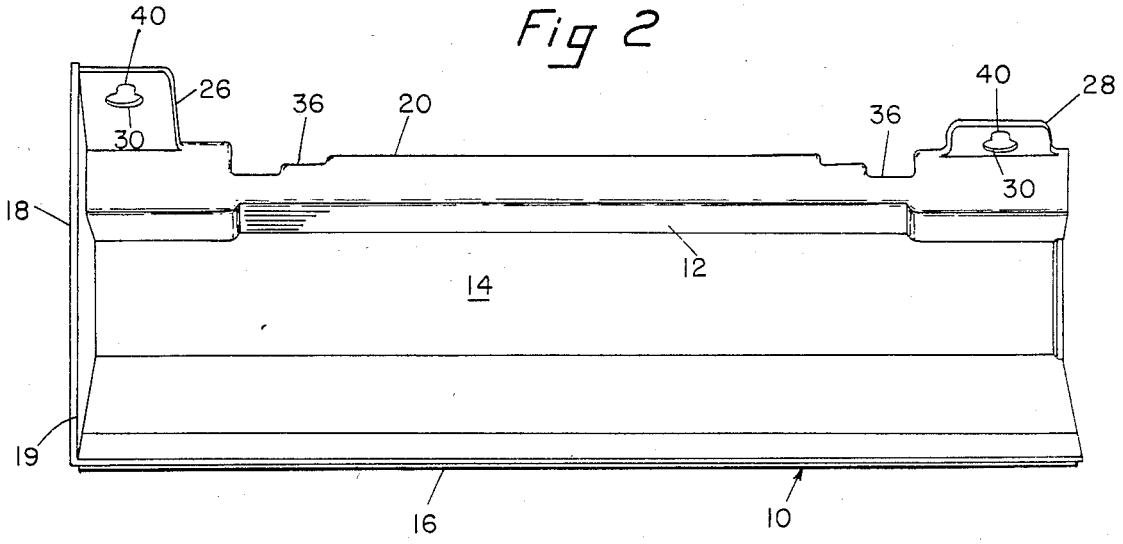
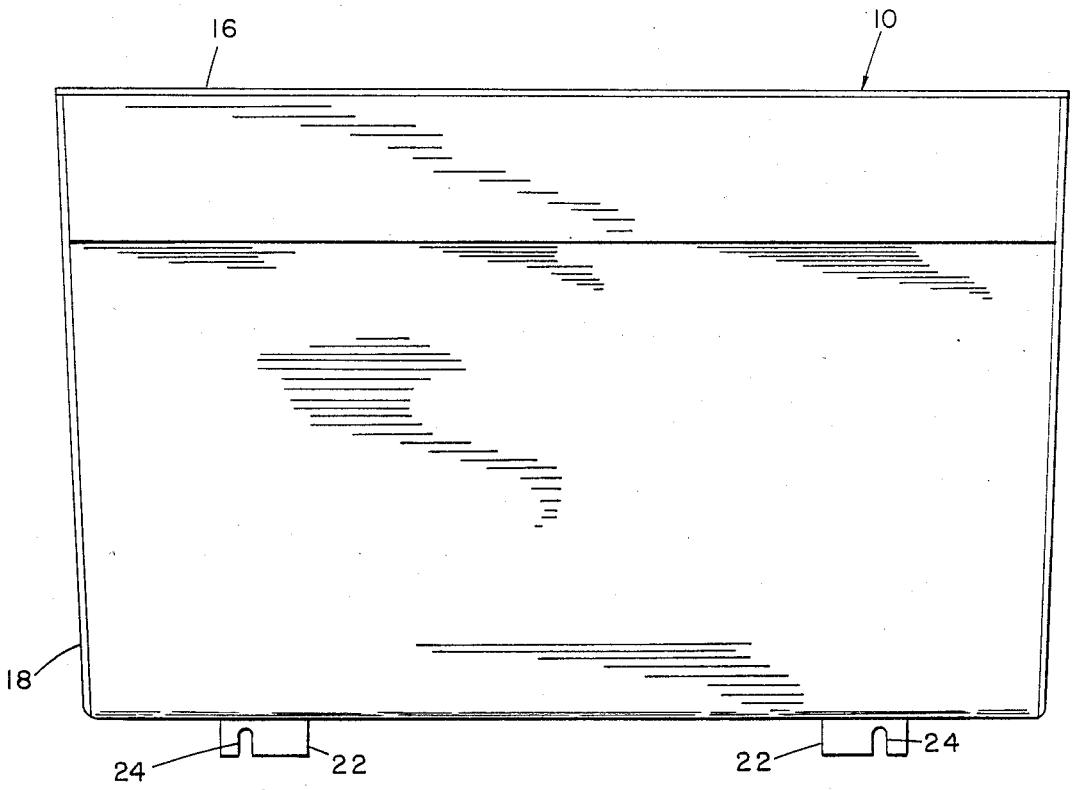
Fig 3

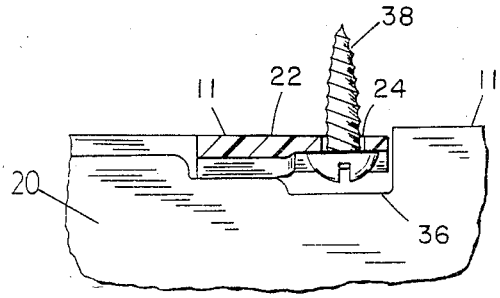
Fig 7
Fig 6
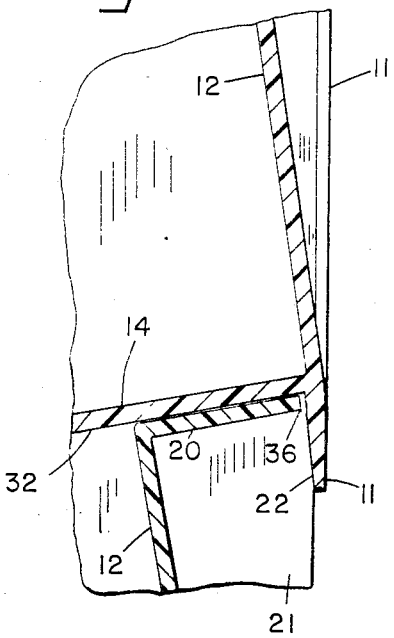
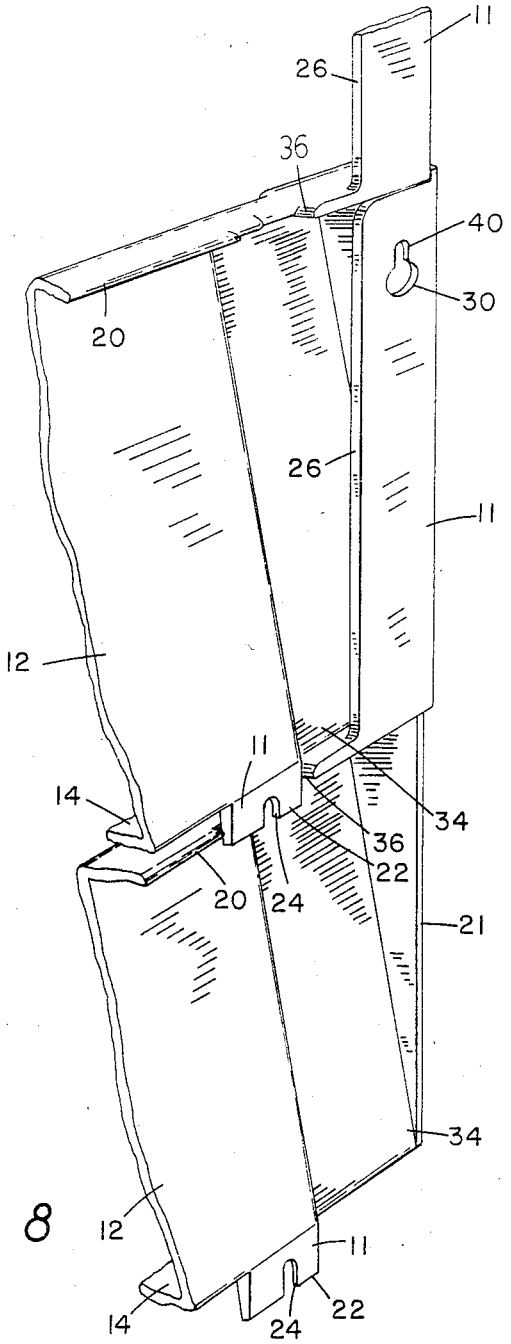
Fig 8

WALL-MOUNTED FILE TRAY

TECHNICAL FIELD

This invention relates to file trays intended to aid in the organization of documents and the like, and in particular, to wall-mounted file trays.

BACKGROUND OF ART

Those skilled in the art are generally cognizant of the use of wall-mounted file trays for aiding in the organization of documents and the like. For example, Bartholomew, U.S. Pat. No. 4,062,452, discloses thin, box-like receptacles that may be arranged on a wall in a vertically stacked row. A first or "primary" file tray is fastened to the wall. It is contemplated in Bartholomew that additional or "secondary" file trays can be added below the first file tray, with each file tray in the row being supported by the preceding one above it through mechanically interlocking parts. Although not discussed in Bartholomew, the structure shown therein would seem also to allow secondary file trays to be added above the primary file tray to be supported thereby.

Similarly, Bobrick, U.S. Pat. No. 4,162,014, discloses a primary file tray fastened to the wall with secondary file trays depending therefrom. Again, all of the secondary file trays are ultimately dependent on the primary file tray for their support. With the file tray of Bobrick, secondary file trays can be added above the primary file tray only by first removing the primary file tray and, in effect, reinstalling it as a secondary file tray depending from a higher, newly installed primary file tray.

Other U.S. patents that disclose the general concept of wall-mounted file trays include Karkut, U.S. Pat. No. 3,430,774; Rorex, U.S. Pat. No. 4,081,080; Genn, et al., U.S. Pat. No. 4,083,456; and Olivan, U.S. Pat. No. 4,099,813. Neither these patents nor Bobrick disclose a wall-mounted file tray of simple design adapted to be added to either the top or bottom of a vertical array of such wall-mounted file trays without the need to remove any of the file trays already mounted in order to install an additional one.

BRIEF SUMMARY OF THE INVENTION

The invention is summarized in that a file tray adapted to be mounted on a generally vertical wall with headed fasteners that are driven into the wall and have heads and shanks, the file tray being adapted to serve both as a primary and a secondary file tray in a vertical array including a primary file tray and at least one secondary file tray, includes a vertically oriented mounting surface adapted to rest against the wall on which the file tray is mounted. A compartment is attached to the mounting surface and is adapted both to nest within a comparable compartment and to receive a comparable compartment in nested relation. The compartment includes a back wall that extends from a selected location on the mounting surface generally upwardly for a distance approximately equal to half the vertical height of the mounting surface and inclines forwardly therefrom. A back wall flange extends from the upwardmost margin of the back wall rearwardly toward the mounting surface. A floor extends from the downwardmost margin of the back wall forwardly. The mounting surface includes at least one bottom mounting tap extending downwardly from the point at which the floor extends from the mounting surface, each bottom mounting tab being adapted to receive and engage the shank of a headed fastener to retain the bottom mounting tap behind the head thereof. The mounting surface also includes at least one top mounting tab extending upwardly from the rearward margin of the back wall flange, each top mounting tab being adapted to receive and engage the shank of a headed fastener to retain the top mounting tab behind the head thereof. The back wall flange has an accommodation notch vertically aligned with each bottom mounting tab, each accommodation notch being adapted to admit a bottom mounting tab when inserted from above, together with the head of any headed fastener engaged thereby. The back wall flange also includes a channel vertically aligned with each top mounting tab and having a depth sufficient to admit a top mounting tab when inserted from beneath, the channels extending upwardly from the downwardmost margin of the back wall. A first file tray may be attached to the wall as a primary file tray by headed fasteners engaged by the bottom and top mounting tabs. Additional file trays may be added as secondary file trays above the primary file tray by engaging the bottom mounting tabs of the secondary file tray in the accommodation notches of the primary file tray and retaining the top mounting tabs of the secondary file tray behind the heads of headed fasteners driven into the wall. The secondary file tray may also be mounted below the primary file tray by engaging the top mounting tabs of the secondary file tray in the channels of the primary file tray and retaining the bottom mounting tabs behind the heads of headed fasteners driven into the wall, all without the need to remove the primary file tray from the wall.

An object of the invention is to provide a wall-mounted file tray that can be combined with other such file trays to create an integrated, vertical array of wall-mounted file trays.

A second object of the invention is to provide a wall-mounted file tray such that each file tray forming a part of such an integrated vertical array of file trays is individually attached to the wall to provide increased strength and durability of the array.

A further object of the invention is to provide such a wall-mounted file tray that is adapted to be so added either to the top or bottom of a vertical array of such file trays without the necessity in the process of removing or altering the mode of attachment of any of the file trays already mounted on the wall.

An additional object of the invention is to provide such a wall-mounted file tray that is convenient to mount, employing a minimum number of mounting screws, all of which may be placed in accessible locations.

Other objects, features, and advantages of the invention will be apparent from the following detailed description taken in conjunction with the accompanying drawings showing a preferred embodiment of a wall-mounted file tray exemplifying the principles of the invention.

BRIEF DESCRIPTION OF THE DRAWINGS

FIG. 2 is a top view of one of the file trays of FIG. 1 looking downwardly at a right angle to the floor.

FIG. 3 is a front view of the file tray of FIG. 2 looking rearwardly parallel to the floor.

FIG. 6 is a fragmentary cross-sectional view taken along section line 6—6 of FIG. 5.

FIG. 7 is a fragmentary cross-sectional view taken along section line 7—7 of FIG. 5.

FIG. 8 is a fragmentary enlarged perspective view of a portion of the rear of the file trays of FIG. 1.

DETAILED DESCRIPTION OF THE PREFERRED EMBODIMENT

Figure 1:
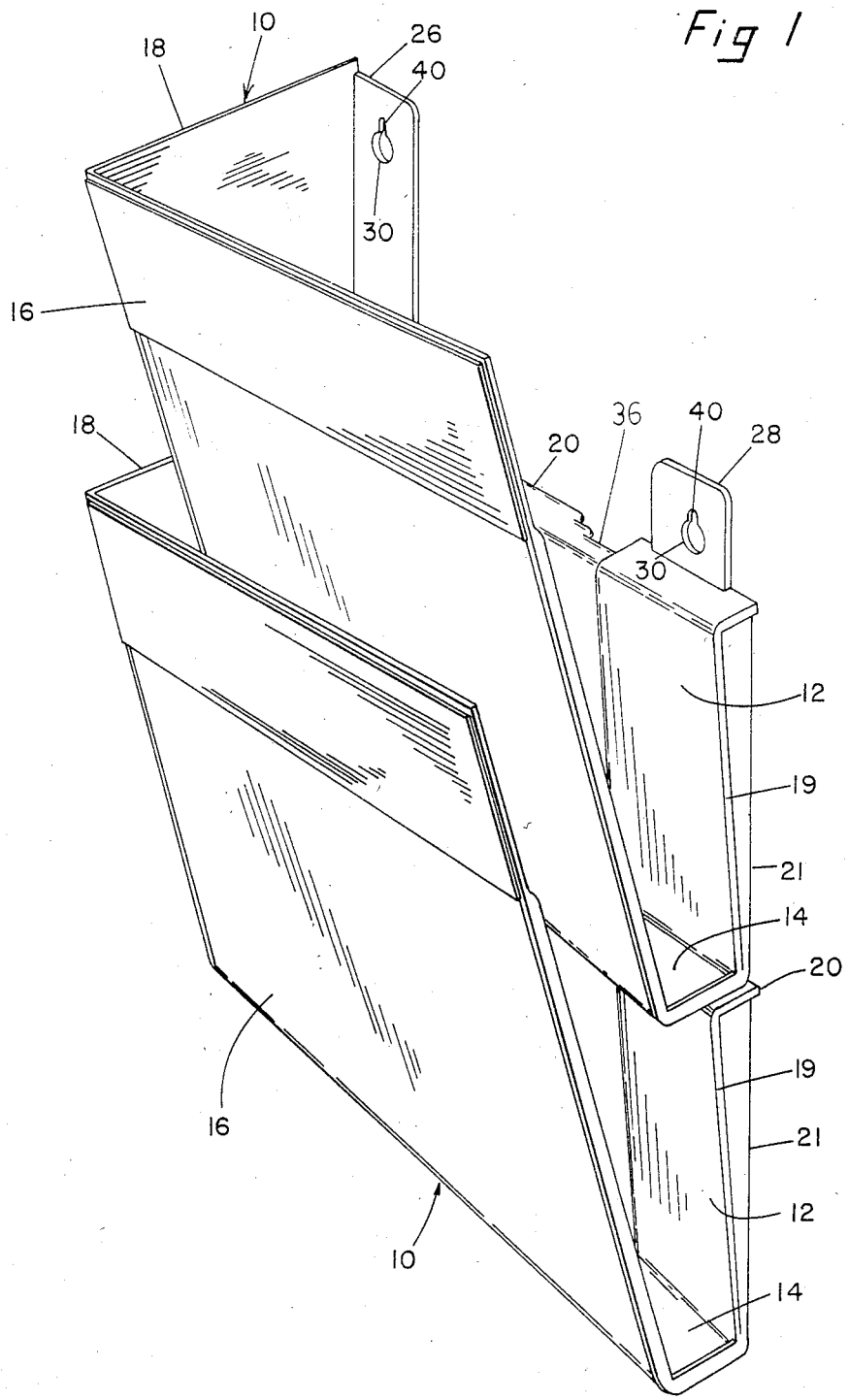
FIG. 1 is a perspective view showing an array of two wall-mounted file trays constructed in accord with the present invention.

Referring more particularly to the drawings, wherein like numbers refer to like parts, FIGS. 2 and 3 show a wall-mounted file tray, generally indicated at 10, constructed in accord with the present invention. For convenience, the file tray 10 will be described below in the orientation that it would assume when mounted on a vertical surface such as a wall. The term "wall" applied to the surface on which the file tray 10 may be mounted shall be understood to include all generally vertical surfaces suitable for the mounting of file trays. The direction that would be toward such a wall will be referred to as "rearward," and the opposite direction will be "forward," so that various parts may be spoken of as being rearwardly or forwardly presented, and so forth.

The file tray 10 includes a vertically oriented mounting surface 11. A back wall 12 extends from a selected location on the mounting surface 11 near the bottom thereof generally upwardly for a distance approximately equal to half of the vertical height of the mounting surface. The back wall 12 inclines forwardly to a selected extent. A back wall flange 20 extends from the upwardmost margin of the back wall 12 rearwardly to the mounting surface 11. A floor 14 extends from the downwardmost margin of the back wall 12 forwardly. The floor 14 is canted slightly downwardly with respect to the vertically oriented mounting surface 11 and preferably intersects the back wall 12 at an angle slightly in excess of 90°.

The file tray 10 also has a front wall 16. The front wall 16 extends from the forward margin of the floor 14 upwardly and forwardly with respect to the vertically oriented mounting surface 11. Preferably the front wall 16 also inclines forwardly slightly away from the back wall 12. A side wall 18 extends rearwardly from one side margin of the front wall 16 to close to a selected extent the space between the front wall, floor 14, back wall 12, and portions of the vertically oriented mounting surface 11 that extend upwardly beyond the back wall. A back wall brace 21 extends rearwardly from each side margin of the back wall 12, generally closing the space between the back wall, the vertically oriented mounting surface 11 and the back wall flange 20. The back wall braces 21 serve to impart rigidity to the back wall 12 and mounting surface 11.

The back wall 12, floor 14, front wall 16, and side wall 18 combine to form a compartment 19 preferably open at the top and to one side. It will be apparent that the size and shape of the compartment 19 can be selected by selecting the size and shape of the floor and the back, front, and side walls. Likewise, the degree to which any of these parts close the space they span may be varied depending on the objects to be held within the compartment 19. Thus, any or all of the back wall 12, floor 14, front wall 16, and side wall 18 may be an open lattice or may be solid, as shown in the Figures. Indeed, if the remaining parts of the compartment 19 are made sufficiently strong, the side wall 18 may be omitted altogether when certain types of objects, such as paper, are to be held within the compartment. Leaving the compartment 19 open to one side increases the flexibility of its use in that objects placed therein may be allowed to extend out the open side. Thus, a file tray 10 of a given size can, for example, be used to store both 15×11 inch computer printouts and conventional 8½ by 11 inch letter sized documents. However, compartments 19 both ends of which are closed are clearly possible and are within the scope and spirit of the invention. The compartment 19 is adapted both to nest within a comparable compartment and to receive a comparable compartment in nested relation, as shall be apparent from the description below.

The vertically oriented mounting surface 11 includes at least one and preferably two laterally spaced bottom mounting tabs 22. The bottom mounting tabs 22 extend downwardly from the point at which the floor 14 intersects the mounting surface 11. The bottom mounting tabs 22 preferably are separated by a selected distance from the back wall braces 21. Each bottom mounting tab 22 has a downwardly opening notch 24 adapted to receive the shank of a screw, nail, or other headed fastener, as will be discussed in greater detail below.

The mounting surface 11 also includes at least one top mounting tab and preferably a first top mounting tab 26 extending upwardly from the rearward margin of the back wall flange 20 at a location immediately adjacent to the side wall 18, the first top mounting tab being rigidly attached to the side wall. The back wall brace 21 thus is generally vertically aligned with the first top mounting tab 26 and extends rearwardly from the adjacent side margin of the back wall 12, as is described above. However, it terminates at a point separated from the mounting surface 11 by a distance equal to the thickness of the first top mounting tab 26.

A second top mounting tab 28 extends upwardly from the rearward margin of the back wall flange 20 at a location remote from the first top mounting tab 26. Preferably, the second top mounting tab 28 extends upwardly from a location adjacent to the back wall brace 21 that is remote from the side wall 18. Each of the first and second top mounting tabs 26, 28 have a bayonet opening 30. The bayonet openings 30 extend from front to rear entirely through the first and second top mounting tabs 26, 28 at locations remote from the back wall flange 20. The bayonet openings 30 are adapted in the conventional way to admit the head and a portion of the shank of a screw, nail, or other headed fastener, such as the screw shown at 38 in FIG. 7, with a constricted, upper part 40 of the bayonet openings 30 having a width sufficient to admit the shank but not the head of the headed fastener. Thus, headed fasteners may be driven into a wall in an appropriate array, and the wall-mounted file tray 10 may be hung thereon, with the top mounting tabs 26, 28 retained under the heads of headed fasteners inserted through the bayonet openings 30 and the bottom mounting tabs 22 retained behind the heads of headed fasteners extending through the downwardly opening notches 24.

Although the vertically oriented mounting surface 11 may be extensive in area, it is preferred that the mounting surface 11 consist primarily of the rearwardly facing surfaces of the top and bottom mounting tabs 26, 28, and 22, the back wall brace 21 remote from the side wall 18, and portions of the back wall flange 20. Because of the lateral separation between the two bottom mounting tabs 22, the two top mounting tabs 26, 28, and the back wall brace 21 referred to and the vertical separation between the top mounting tabs and bottom mounting tabs, the wall-mounted file tray 10 may be firmly mounted to a wall with a stability comparable to that which would have been achieved had the mounting surface 11 been continuous over the width and height of the file tray. However, it will be apparent that the file tray 10 of the invention can be mounted with only one bottom mounting tab 22 and one top mounting tab 26, 28, with more than two of each type of tab, or with any combination. Such alternative embodiments are within the scope and spirit of the invention.

The floor 14 has a downwardly facing surface 32. The distance from the back wall flange 20 upwardly to the upwardmost margin of the first top mounting tab 26 and the distance from the back wall flange downwardly to the downwardly facing surface 32 of the floor 14 is selected to be substantially the same. In any event, the first distance described does not exceed the second distance. The back wall 12 has rearwardly opening channels 34 that extend upwardly from the downwardmost margin of the back wall 12. A channel 34 is vertically aligned with each of the top mounting tabs 26, 28, each channel having a depth at the downwardmost margin of the back wall 12 substantially the same as the thickness of the top mounting tab with which it is aligned.

The back wall flange 20 has accommodation notches 36 vertically aligned with the bottom mounting tabs 22. The accommodation notches 36 are rearwardly opening and extend forwardly from the mounting surface 11 for a distance at least equal to the thickness of the bottom mounting tabs 22 and the head of a headed fastener engaged in the downwardly opening notches 24 of the bottom mounting tabs, as is clearly illustrated in FIG. 7.

In use, a first or "primary" wall mounted file tray 10 may be mounted on a wall. A user must first drive headed fasteners into the wall at locations corresponding to the positions of the downwardly opening notches 24 of the bottom mounting tabs 22 and the bayonet openings 30 of the first and second top mounting tabs 26, 28, with the heads of the headed fasteners being spaced from the wall a distance at least as great as the thickness of the corresponding mounting tabs. The notches 24 and bayonet openings 30 may then be slipped over the heads of the headed fasteners. The file tray 10 may then be shifted downwardly until its weight is borne by the shanks of the headed fasteners, with the heads thereof retaining the file tray in place on the wall.

Figure 5:
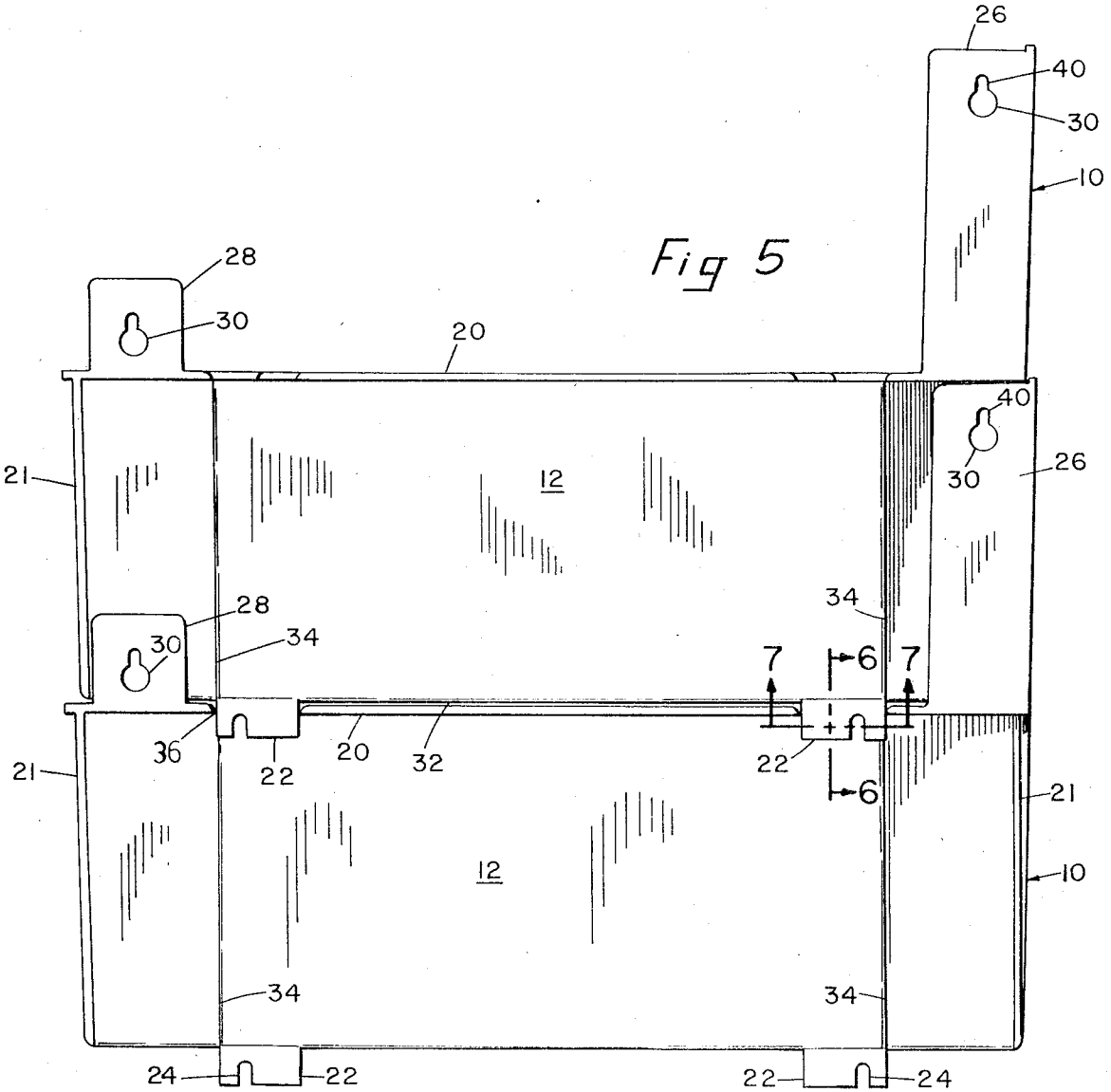
FIG. 5 is a rear elevation view of the two file trays of FIG. 1.
Figure 4:
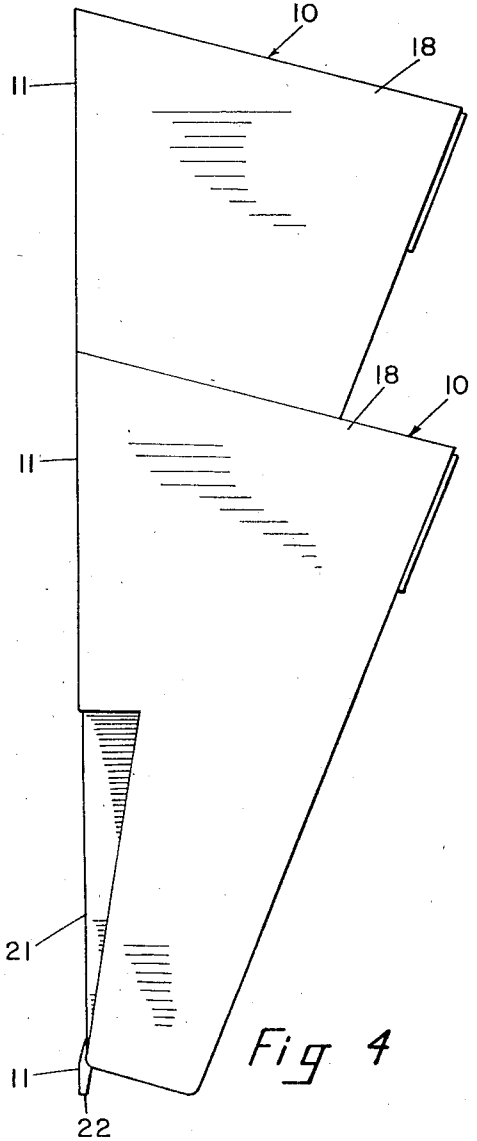
FIG. 4 is a left side elevation view of the two file trays of FIG. 1.

The wall-mounted file tray 10 of the invention is adapted to be used singly or in groups. When used in groups, the wall-mounted file tray 10 may be arranged in vertically extended arrays of file trays, such as the array of two file trays shown in FIGS. 1, 4, and 5. To construct such an array, a primary file tray 10 is first mounted on the wall in the manner set forth above. Secondary file trays 10 may then be mounted either above or below the primary file tray, without any need to remove the primary file tray from the wall.

In the event the secondary file tray is mounted above the primary file tray, it is held against the wall above and in vertical alignment with the primary file tray. It is then slid downwardly until its bottom mounting tabs 22 enter the accommodation notches 36 of the primary file tray in mating relation, as may be seen clearly in FIGS. 5, 6, 7, and 8. The location of the bayonet openings 30 of the secondary file tray may then be noted and, after the secondary file tray is slid upwardly and removed, headed fasteners may be driven into the wall at those points. The secondary file tray may then be replaced, with the bottom mounting tabs 22 inserted into the accommodation notches 36 and the bayonet openings 30 of the secondary file tray engaged over the heads of the headed fasteners. The downwardly facing surface 32 of the floor 14 of the secondary file tray may be allowed to rest on the back wall flange 20 of the primary file tray, distributing some of the weight of the secondary file tray and its contents to the headed fasteners supporting the primary file tray. Preferably the accommodation notches 36 are so located relative to the bottom mounting tabs 22 that sidewise movement of the secondary file tray is inhibited.

If the secondary file tray is to be mounted beneath the primary file tray, the primary file tray is first mounted in the manner set forth above. Then the secondary file tray is placed against the wall beneath the primary file tray in vertical alignment therewith. The secondary file tray may then be slid upwardly until its first and second top mounting tabs 26, 28 are inserted in mating relationship within the channels 34 of the primary file tray and the bottom mounting tabs 22 of the primary file tray are similarly inserted within the accommodation notches 36 of the secondary file tray, a relationship most easily seen in FIGS. 5 and 8. Headed fasteners may then be driven into the wall, passing snugly through the downwardly opening notches 24 of the bottom mounting tabs 22 of the secondary file tray. The mating relationship of the top mounting tabs 26, 28 of the secondary file tray and the channels 34 of the primary file tray prevent forward motion of the uppermost part of the secondary file tray, while the headed fasteners inserted through the notches 24 of the bottom mounting tabs 22 of the secondary file tray support the weight of the secondary file tray and prevent any downward movement thereof.

Preferably the side wall 18 inclines sidewardly, away from the floor 14, to an extent sufficient to allow file trays 10 to be mounted directly above or below each other in vertically nested relation, as described above. Thus, the distance from the side wall 18 at the level of the back wall flange 20 to a vertical line drawn upwardly from the bottom margin of the side wall is approximately one-half the distance from the side wall at its top margin to the same vertical line.

It will be apparent from the figures and disclosure above that, when two or more file trays 10 are mounted in a vertical array, forwarding facing surfaces of the front wall 16 of a given file tray serve effectively as an extension of the forwardly facing surfaces of the back wall 12 of the file tray 10 next below. This interaction of surfaces can be easily seen in FIG. 1. Preferably, the floor 14 is greater or at least as great in depth from front to rear as is the back wall flange 20. As a consequence, the front wall 16 of the first file tray 10 serves to guide and deflect papers and other objects placed within a second file tray 10 mounted beneath it so as to avoid any jamming of those objects against upwardly facing surfaces of the back wall flange of the second file tray.

It will be apparent to one skilled in the art that the relative orientation of the parts of the wall-mounted file tray 10 of the invention described above is such that the file tray may be unitarily molded by injection molding or comparable plastic forming techniques. That is the preferred method of manufacture of the file tray 10. However, the file tray 10 may also be made from wood, metal, or other suitable, rigid materials by conventional methods of working those materials. Thus, although the particular construction and arrangement of parts illustrated and disclosed above is that preferred, the present invention is not limited thereto. Instead, it embraces all such modified forms thereof as come within the scope of the following claims.

What is claimed is:

1. A file tray adapted to be mounted on a generally vertical wall with headed fasteners that are driven into the wall and have heads and shanks, the file tray being adapted to serve both as a primary and a secondary file tray in a vertical array including a primary file tray and at least one secondary file tray, the file tray comprising:

a vertically oriented mounting surface adapted to rest against the wall on which the file tray is mounted; and a compartment attached to the mounting surface and including a back wall extending upwardly from a selected location on the mounting surface for a selected portion of the vertical height thereof and a floor extending from the back wall forwardly;

the mounting surface including:

(a) at least one bottom mounting tab extending downwardly beneath the back wall, the bottom mounting tab having an aperture therethrough to receive and engage the shank of a headed fastener and being adapted to be retained behind the head of the fastener; and (b) at least one top mounting tab extending upwardly above the back wall, the top mounting tab having an aperture therethrough to receive and engage the shank of a headed fastener and being adapted to be retained behind the head of the fastener;

the back wall including a channel vertically aligned with the top mounting tab and having a depth sufficient to admit a top mounting tab when inserted from beneath, the channel extending upwardly from the downwardmost margin of the back wall and forwardly from the mounting surface, the back wall also having a rearwardly opening notch to so accommodate the bottom mounting tabs of a file tray when said bottom mounting tabs are moved into place from above as to provide unrestricted access for such bottom mounting tabs to the wall on which the file tray is to be mounted;

whereby a first file tray may be attached to the wall as a primary file tray by headed fasteners engaged by the bottom and top mounting tabs and additional file trays may be added as secondary file trays both above and below the primary file tray, all without the need to remove the primary file tray from the wall.

2. The file tray of claim 1 in which the compartment opens upwardly and to one side to allow placement within the compartment of objects greater in size than the compartment.

3. The file tray of claim 1 wherein the floor has a downwardly facing surface such that, when a first file tray is mounted on a wall, the downwardly facing surface of the floor of a second file tray mounted above the first file tray may rest against an upwardly facing portion of the back wall of the first file tray, facilitating placement of the file trays in a vertically aligned array.

4. The file tray of claim 3 in which the compartment includes a front wall extending from the forward margin of the floor upwardly and forwardly with respect to the vertically oriented mounting surface, the front wall having forwardly facing surfaces presented away from the mounting surface, and wherein the floor is sufficiently great in depth from front to rear that the forwardly facing surfaces of the front wall of the second file tray guide and deflect objects placed within the first file tray mounted beneath the second file tray so as to avoid any jamming of those objects against upwardly presented surfaces of the back wall of the first file tray.

5. A file tray adapted to be mounted on a generally vertical wall with headed fasteners that are driven into the wall and have heads and shanks, the file tray being adapted to serve both as a primary and a secondary file tray in a vertical array including a primary file tray and at least one secondary file tray, the file tray comprising:

a vertically oriented mounting surface adapted to rest against the wall on which the file tray is mounted; and a compartment attached to the mounting surface and adapted both to nest within a comparable compartment and to receive a comparable compartment in nested relation;

the compartment including:

(a) a back wall extending from a selected location on the mounting surface generally upwardly for a selected portion of the vertical height of the mounting surface and inclining forwardly therefrom;

(b) a back wall flange extending from the upwardmost margin of the back wall rearwardly toward the mounting surface; and (c) a floor extending from the downwardmost margin of the back wall forwardly;

the mounting surface including (a) at least one bottom mounting tab extending downwardly from the point at which the floor extends from the mounting surface, each bottom mounting tab being adapted to receive and engage the shank of a headed fastener to retain the bottom mounting tab behind the head thereof; and (b) at least one top mounting tab extending upwardly from the rearward margin of the back wall flange, each top mounting tab being adapted to receive and engage the shank of a headed fastener to retain the top mounting tab behind the head thereof; and the back wall flange having an accommodation notch vertically aligned with each bottom mounting tab, each accommodation notch being adapted to admit a bottom mounting tab when inserted from above, together with the head of any headed fastener engaged thereby; and the back wall having a channel vertically aligned with each top mounting tab and having a depth sufficient to admit a top mounting tab when inserted from beneath, the channels extending upwardly from the downwardmost margin of the back wall;

whereby a first file tray may be attached to the wall as a primary file tray by headed fasteners engaged by the bottom and top mounting tabs, and additional file trays may be added as secondary file trays above the primary file tray by engaging the bottom mounting tabs of the secondary file tray in the accommodation notches of the primary file tray and retaining the top mounting tabs of the secondary file tray behind the heads of headed fasteners driven into the wall, the secondary file tray also being mountable below the primary file tray by engaging the top mounting tabs of the secondary file tray in the channels of the primary file tray and retaining the bottom mounting tabs behind the heads of headed fasteners driven into the wall, all without the need to remove the primary file tray from the wall.

6. The file tray of claim 5 wherein the floor has a downwardly facing surface such that, when a first file tray is mounted on a wall, the downwardly facing surface of the floor of a second file tray mounted above the first file tray may rest upon the back wall flange of the first file tray, transmitting a portion of the weight of the second file tray thereto and facilitating placement of the file trays in a vertically aligned array.

7. The file tray of claim 6 wherein at least one of the top mounting tabs extends upwardly for a distance substantially the same as the distance from the back wall flange downwardly to the downward facing surface of the floor, so that the back wall flange of the second file tray mounted above the first file tray may rest on the upward margin of the top mounting tab of the first file tray.

8. The file tray of claim 5 in which the compartment additionally includes a front wall extending upwardly from the forward margin of the floor in spaced relation to the back wall and a side wall extending between the front wall and the back wall, the compartment opening upwardly and to the side remote from the side wall to allow placement within the compartment of objects greater in size than the compartment.

9. The file tray of claim 6 in which the compartment includes a front wall extending from the forward margin of the floor upwardly and forwardly with respect to the vertically oriented mounting surface, the front wall having forwardly facing surfaces presented away from the mounting surface, and wherein the floor is at least as great in depth from front to rear as is the back wall flange, whereupon the forwardly facing surfaces of the front wall of the second file tray guide and deflect objects placed within the first file tray mounted beneath the second file tray so as to avoid any jamming of those objects against the back wall flange of the first file tray.

10. A file tray adapted to be mounted on a generally vertical wall with headed fasteners that are driven into the wall and have heads and shanks, the file tray being adapted to serve both as a primary and a secondary file tray in a vertical array including a primary file tray and at least one secondary file tray, the file tray comprising:

(a) a vertically oriented mounting surface adapted to rest against the wall on which the file tray is mounted;

(b) a back wall extending from a selected location on the mounting surface generally upwardly for a selected portion of the vertical height of the mounting surface and inclining forwardly therefrom;

(c) a back wall flange extending from the upwardmost margin of the back wall rearwardly toward the mounting surface;

(d) a floor extending from the downwardmost margin of the back wall forwardly;

(e) a front wall extending from the forward margin of the floor upwardly and forwardly with respect to the vertically oriented mounting surface; and (f) a side wall extending rearwardly from one side margin of the front wall to substantially close the space between the front wall, floor, back wall, and selected portions of the vertically oriented mounting surface that extend upwardly beyond the back wall;

the mounting surface including at least one bottom mounting tab extending downwardly from the point at which the floor extends from the mounting surface, each bottom mounting tab having a downwardly opening notch adapted to receive and engage the shank of a headed fastener to retain the bottom mounting tab behind the head thereof, the mounting surface also including at least one top mounting tab extending upwardly from the rearward margin of the back wall flange, each top mounting tab having a bayonet opening adapted to admit the head and a portion of the shank of a headed fastener to engage the bayonet opening over the headed fastener;

the back wall flange having an accommodation notch vertically aligned with each bottom mounting tab, the accommodation notches opening rearwardly and extending forwardly from the mounting surface for a distance at least equal to the thickness of the bottom mounting tabs and the head of any headed fastener engaged in the downwardly opening notches thereof; and the back wall including a channel vertically aligned with each top mounting tab and having a depth at the downwardmost margin of the back wall not less than the thickness of the top mounting tab with which it is aligned, the channels opening rearwardly and extending upwardly from the downwardmost margin of the back wall;

whereby a first file tray may be attached to the wall as a primary file tray by headed fasteners engaged in the downwardly opening notches of the bottom mounting tabs and the bayonet openings of the top mounting tabs, and additional file trays may be added as secondary file trays above the primary file tray by engaging the bottom mounting tabs of the secondary file tray in the accommodation notches of the primary file tray and further engaging the bayonet openings of the secondary file tray over additional headed fasteners driven into the wall, the secondary file tray also being mountable below the primary file tray by engaging the top mounting tabs of the secondary file tray in the channels of the primary file tray and engaging the downwardly opening notches of the secondary file tray behind the heads of headed fasteners driven into the wall, all without the need to remove the primary file tray from the wall.

11. The file tray of claim 10 wherein the floor has a downwardly facing surface such that, when a first file tray is mounted on a wall, the downwardly facing surface of the floor of a second file tray mounted above the first file tray may rest upon the back wall flange of the first file tray, transmitting a portion of the weight of the second file tray thereto and facilitating placement of the file trays in a vertically aligned array.

12. The file tray of claim 11 wherein at least one of the top mounting tabs extends upwardly for a distance substantially the same as the distance from the back wall flange downwardly to the downwardly facing surface of the floor, so that the back wall flange of the second file tray mounted above the first file tray may rest on the upward margin of the top mounting tab of the first file tray.

13. The file tray of claim 10 in which the back wall, floor, front wall, and side wall combine to form a compartment having a selected size, the compartment being open upwardly and to the side remote from the side wall to allow placement within the compartment of objects greater in size than the compartment.

14. The file tray of claim 11 wherein the floor is at least as great in depth from front to rear as is the back wall flange and the front wall has forwardly facing surfaces presented away from the mounting surface such that the forwardly facing surfaces of the front wall of the second file tray guide and deflect objects placed within the first file tray mounted beneath the second file tray so as to avoid any jamming of those objects against the back wall flange of the first file tray.

* * * * *